US009622529B2

(12) United States Patent
Teetzel et al.

(10) Patent No.: US 9,622,529 B2
(45) Date of Patent: Apr. 18, 2017

(54) HELMET EDGE TRIM WIRING HARNESS

(71) Applicant: Wilcox Industries Corp., Newington, NH (US)

(72) Inventors: James W. Teetzel, Portsmouth, NH (US); Justin D. Harris, Haverhill, MA (US)

(73) Assignee: Wilcox Industries Corp., Newington, NH (US)

( * ) Notice: Subject to any disclaimer, the term of this patent is extended or adjusted under 35 U.S.C. 154(b) by 765 days.

(21) Appl. No.: 13/939,587

(22) Filed: Jul. 11, 2013

(65) Prior Publication Data

US 2014/0020159 A1 Jan. 23, 2014

Related U.S. Application Data

(60) Provisional application No. 61/672,908, filed on Jul. 18, 2012.

(51) Int. Cl.
*A42B 3/04* (2006.01)

(52) U.S. Cl.
CPC ..... *A42B 3/0406* (2013.01); *A42B 3/04* (2013.01)

(58) Field of Classification Search
CPC ..... A43B 3/044; A43B 3/0433; A43B 3/0446
USPC ..... 362/103, 105
See application file for complete search history.

(56) References Cited

U.S. PATENT DOCUMENTS 3,302,018 A * 1/1967 Harding ..... A42B 3/044 362/106
4,231,079 A * 10/1980 Heminover ..... A41D 27/085 362/106
4,891,736 A * 1/1990 Gouda ..... A42B 3/0453 362/105
4,901,210 A * 2/1990 Hanabusa ..... A42B 3/044 2/422
5,034,747 A * 7/1991 Donahue ..... A42B 3/0433 2/410
5,408,393 A * 4/1995 Becker ..... A42B 3/044 362/105
5,469,342 A * 11/1995 Chien ..... A42B 1/242 224/660
5,559,680 A * 9/1996 Tabanera ..... A42B 3/044 362/106
5,564,128 A * 10/1996 Richardson ..... A42B 3/044 2/422
5,570,946 A * 11/1996 Chien ..... A42B 3/044 362/106
5,688,039 A * 11/1997 Johnson ..... A42B 3/0446 362/106
5,810,467 A * 9/1998 Hurwitz ..... A42B 3/044 2/422
5,836,673 A * 11/1998 Lo ..... A41D 13/01 362/103
5,871,271 A * 2/1999 Chien ..... A42B 3/044 362/103

(Continued)

*Primary Examiner* — Richale Quinn
(74) *Attorney, Agent, or Firm* — McLane Middleton, Professional Association

(57) ABSTRACT

An improved helmet construction and method having a circuit carried within an edge trim member received over the unfinished edge of the helmet shell. A plurality of electrical connectors are provided at different locations on the helmet for providing power, data transmission, and/or signal transmission to one or more accessory devices on the helmet.

19 Claims, 9 Drawing Sheets

(56) References Cited

U.S. PATENT DOCUMENTS 6,007,213 A * 12/1999 Baumgartner ..... A42B 3/044 362/105
6,244,721 B1 * 6/2001 Rodriguez ..... A42B 3/044 362/105
6,325,521 B1 * 12/2001 Gregg ..... A42B 3/0433 362/106
6,456,261 B1 * 9/2002 Zhang ..... A42B 3/042 345/7
6,619,831 B2 * 9/2003 Kanesaka ..... B60Q 3/0289 362/103
6,659,618 B2 * 12/2003 Waters ..... F21V 21/084 362/105
6,849,849 B1 2/2005 Warner et al. ..... 250/330
7,219,370 B1 5/2007 Teetzel et al. ..... 2/6.2
7,234,831 B1 * 6/2007 Hanley ..... A42B 1/244 2/209.13
7,311,413 B1 * 12/2007 Barnes ..... A42B 3/044 362/106
7,452,106 B2 * 11/2008 Tseng ..... H05B 33/0842 362/103
7,570,301 B2 8/2009 Gilor ..... 348/373
7,621,000 B1 * 11/2009 Fulton ..... A42B 1/24 2/195.1
8,063,934 B2 * 11/2011 Donato ..... A42B 3/042 345/8
8,070,307 B2 * 12/2011 Ho ..... A42B 3/044 362/106
8,117,676 B1 * 2/2012 Cardoso ..... A42B 3/044 2/410
8,157,402 B2 * 4/2012 Huss ..... A42B 3/0433 362/103
8,388,164 B2 * 3/2013 Waters ..... G02C 11/04 174/74 A
8,529,082 B1 * 9/2013 Baker ..... F21V 33/0076 362/105
8,757,831 B2 * 6/2014 Waters ..... A42B 1/244 200/566
8,813,268 B1 * 8/2014 Fitzgerald ..... A42B 1/242 2/422
2002/0118532 A1 * 8/2002 Gates ..... A42B 3/044 362/105
2002/0120979 A1 * 9/2002 Prendergast ..... A42B 3/04 2/422
2002/0145865 A1 * 10/2002 Gregg ..... G02B 6/0008 362/106
2002/0159250 A1 * 10/2002 Kuo ..... A42B 3/044 362/106
2003/0058544 A1 3/2003 Bianco et al. ..... 359/630
2003/0122958 A1 7/2003 Olita et al. ..... 348/33
2004/0264176 A1 * 12/2004 Vanderschuit ..... A42B 1/244 362/106
2005/0174753 A1 * 8/2005 Cao ..... A42B 3/044 362/106
2006/0291849 A1 12/2006 Shamir et al. ..... 396/334
2007/0035707 A1 2/2007 Margulis ..... 353/122
2007/0064413 A1 * 3/2007 Slater ..... A42B 1/244 362/106
2007/0083967 A1 * 4/2007 Crossman ..... A42B 3/044 2/15
2007/0084985 A1 4/2007 Smith et al. ..... 250/207
2007/0214551 A1 9/2007 Teetzel et al. ..... 2/422
2008/0080171 A1 * 4/2008 Lombard ..... A42B 3/044 362/106
2008/0136960 A1 6/2008 Kawakami ..... 348/371
2009/0109286 A1 4/2009 Ennis ..... 348/81
2009/0109292 A1 4/2009 Ennis ..... 348/158
2010/0001927 A1 1/2010 Hough et al. ..... 345/8
2011/0210685 A1 * 9/2011 Liao ..... H05B 37/02 315/313
2012/0224356 A1 * 9/2012 Fischer ..... F21V 21/084 362/106
2013/0033852 A1 * 2/2013 Liao ..... A42B 1/24 362/106
2015/0062886 A1 * 3/2015 Leegate ..... A42B 3/044 362/190
2015/0320133 A1 * 11/2015 Tutor ..... A42B 3/0433 2/410
2015/0327615 A1 * 11/2015 Gelb ..... A42B 3/044 362/105

* cited by examiner

HELMET EDGE TRIM WIRING HARNESS

CROSS REFERENCE TO RELATED APPLICATION

This application claims priority to U.S. Provisional Application No. 61/672,908 filed Jul. 18, 2012. The aforementioned application is incorporated by reference in its entirety.

BACKGROUND

The present disclosure relates generally to protective helmets such as ballistic helmets or other helmets having a similar construction, such as a ballistic tactical helmet for use by law enforcement personnel, military field or combat helmets, or the like. More particularly, the present disclosure relates to a helmet edge trim and a helmet employing same with integral wiring for routing electrical power or signals to one or more electrical or electronic accessory devices or components attached or mounted to the helmet.

Commonly, a military ballistic helmet or the like is configured with mounts, brackets, or the like to carry one or more accessories or attachments, such as a flashlights, viewing optics and devices, such as a monocular, binoculars, monocular or binocular night vision (NVG) devices (including passive night vision devices and enhanced night vision (eNVG) devices), thermal imaging devices, cameras, friend or foe identification (IFF) systems, communications devices, and so forth.

To connect accessories to an electrical source, a wiring harness may be routed along the interior of the helmet. However, an internally routed wire harnesses may be subject to chemical attack due to perspiration, damaged through impact with the wearer's head, and so forth. In addition, an internally routed wiring harness may require one or more holes or vias through the ballistic material of the helmet, thus compromising the antiballistic properties of the helmet in these regions. Alternatively, a wire harness may be routed externally over the exterior surface of the helmet. However, external wiring harnesses may be cumbersome and susceptible to failure.

In addition, the number and complexity of helmet mounted components is increasing, with such components often including computer or microcontroller-based devices controlled through the use of electronic signals and sensors. This results in the need for larger and more complex wiring assemblies and poses difficulties in installing such devices while maintaining the ballistic integrity of the helmet.

Therefore, there exists a need for an improved helmet construction and method having an integrated accessory mounting and electrical interconnection device which could replace the wiring typically used for electrical power, data, and/or signal transmission and which would reduce wiring complexity, simplify helmet assembly and device attachment.

SUMMARY

A helmet system and method are provided that allow an electrical connection between one or more electrical or electronic components on the helmet by integrating a wiring harness or other flexible circuit between the edge trim and the brim of a helmet shell.

In preferred aspects, the helmet system and method allow a secure connection of helmet mounted accessories to the helmet without the need to run an exposed wiring harness over the exterior surface of the helmet shell and without the need to penetrate the ballistic shell with wiring vias. One advantage of the present development is that the edge trim with circuit components as described herein may be retrofit to any existing helmet by replacing existing edge trim with the edge trim as described herein, and may be adapted for use with any existing helmet design. It is to be understood that both the following detailed description is exemplary and explanatory only and are not restrictive of the invention.

In one aspect, a protective helmet includes an outer shell bounded by a peripheral edge and an edge trim attached to and extending around the peripheral edge. A wiring harness is disposed within the edge trim.

In a more limited aspect, the wiring harness is integral with the edge trim.

In another more limited aspect, the wiring harness is received between the peripheral edge and the edge trim.

In still another more limited aspect, the wiring harness comprises a plurality of conductive elements.

In another more limited aspect, the wiring harness is selected from a ribbon cable and a flexible circuit substrate carrying one or more printed circuit elements.

In yet another more limited aspect, the wiring harness comprises a flexible circuit substrate formed of a flexible polymer film having one or more conductive elements printed thereon.

In another more limited aspect the edge trim defines a channel receiving the peripheral edge.

In still another more limited aspect, the protective helmet includes one or more power connectors on the outer shell configured to attach to an electrical power source and one or more device connectors on the outer shell configured to connect to an electrically powered device. The wiring harness is electrically coupled to the one or more power connectors and the one or more device connectors.

In another more limited aspect, each of the one or more the power connectors includes a mechanical fastener for removably attaching a power source and further includes a first set of electrical contacts which is aligned with a second set of electrical contacts on the power source when the power source is attached.

In yet another more limited aspect, the power supply is selected from a battery and a battery pack.

In another more limited aspect, each of the one or more the device connectors includes a mechanical fastener for removably attaching a powered device and further including a first set of electrical contacts which is aligned with a second set of electrical contacts on the powered device when the powered device is attached.

In still another more limited aspect, the protective helmet further includes one or more powered devices selected from the group consisting of flashlights, illumination devices, passive night vision devices, enhanced night vision devices, thermal imaging devices, cameras, video recorders, and friend or foe identification (IFF) devices.

In another more limited aspect, the protective helmet further includes a mount attached to a front portion of the outer shell for positioning a viewing device in front of an eye of a user wearing the helmet.

In yet another more limited aspect, the protective helmet is a ballistic helmet.

In another more limited aspect, the outer shell comprises a ballistic shell formed of multiple plies of reinforcing fibers within a polymer matrix material.

In yet another more limited aspect, the edge trim is formed of a material selected from a molded polymer material and an extruded polymer material.

In another more limited aspect, the wiring harness includes a plurality of conductors for transmitting one or more of power, data signals, sensor signals, and communication signals.

In still another more limited aspect, the peripheral edge is unfinished.

In another more limited aspect, the edge trim is secured to the peripheral edge with a mechanical fastener.

In yet another more limited aspect, the edge trim is permanently secured to the peripheral edge with an adhesive.

In another more limited aspect, the adhesive is an epoxy adhesive.

It is to be understood that both the foregoing general description and the following detailed description are exemplary and explanatory only and are not restrictive of the invention as claimed. The accompanying drawings, which are incorporated in and constitute a part of the specification, illustrate preferred embodiments of the invention and together with the general description, serve to explain the principles of the invention, and are not to be construed as limiting the invention.

BRIEF DESCRIPTION OF THE DRAWINGS

The invention may be better understood by those skilled in the art by reference to the accompanying drawing figures, in which.

DETAILED DESCRIPTION OF THE PREFERRED EMBODIMENT

Figure 1:
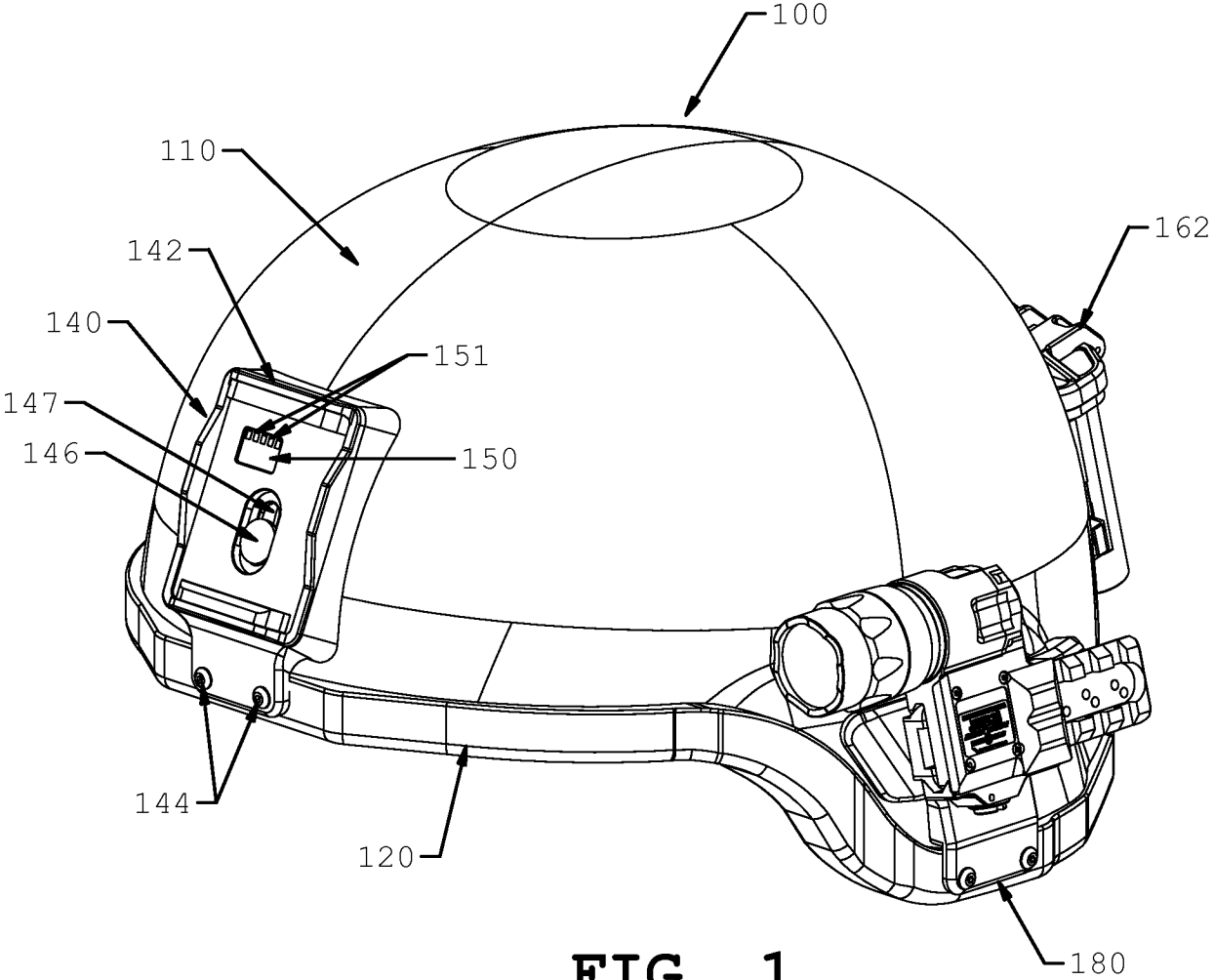
FIG. 1 is an isometric view, taken generally from the front and side, of an exemplary helmet in accordance with the present disclosure.
Figure 2:
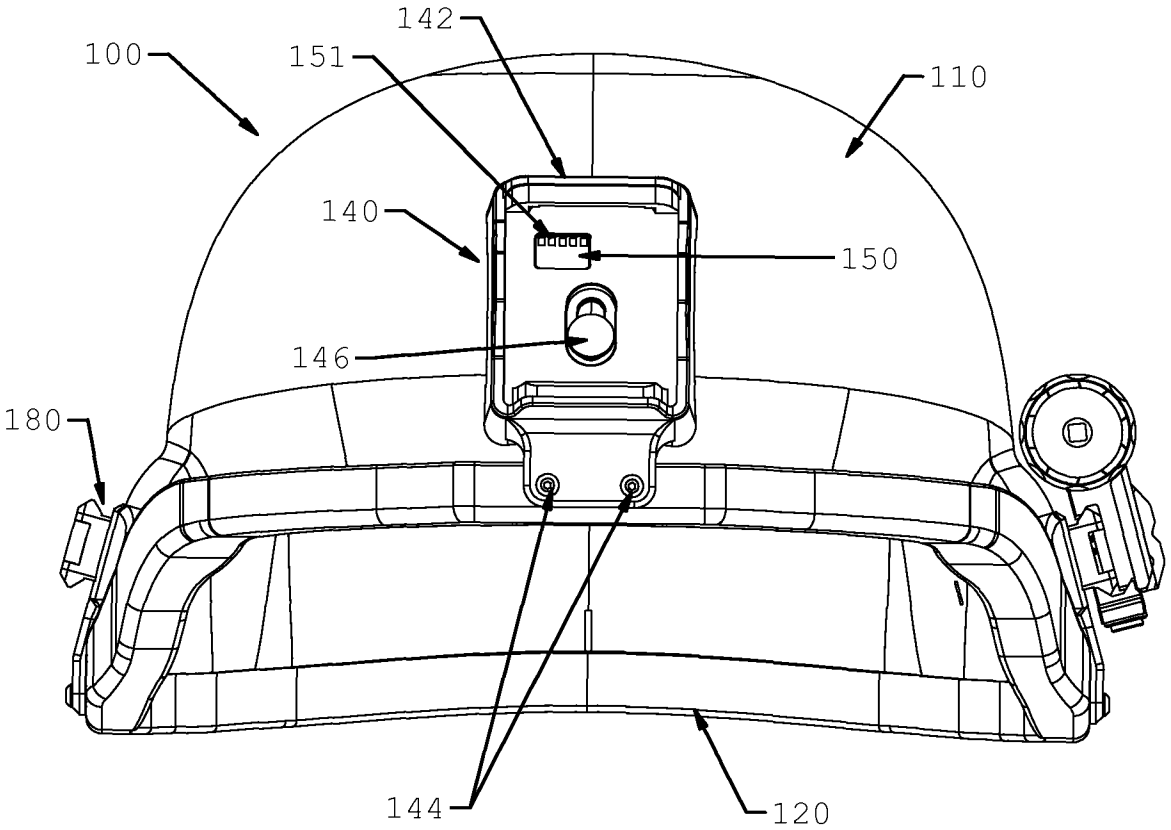
FIG. 2 is a front elevational view of the embodiment appearing in FIG. 1.
Figure 3:
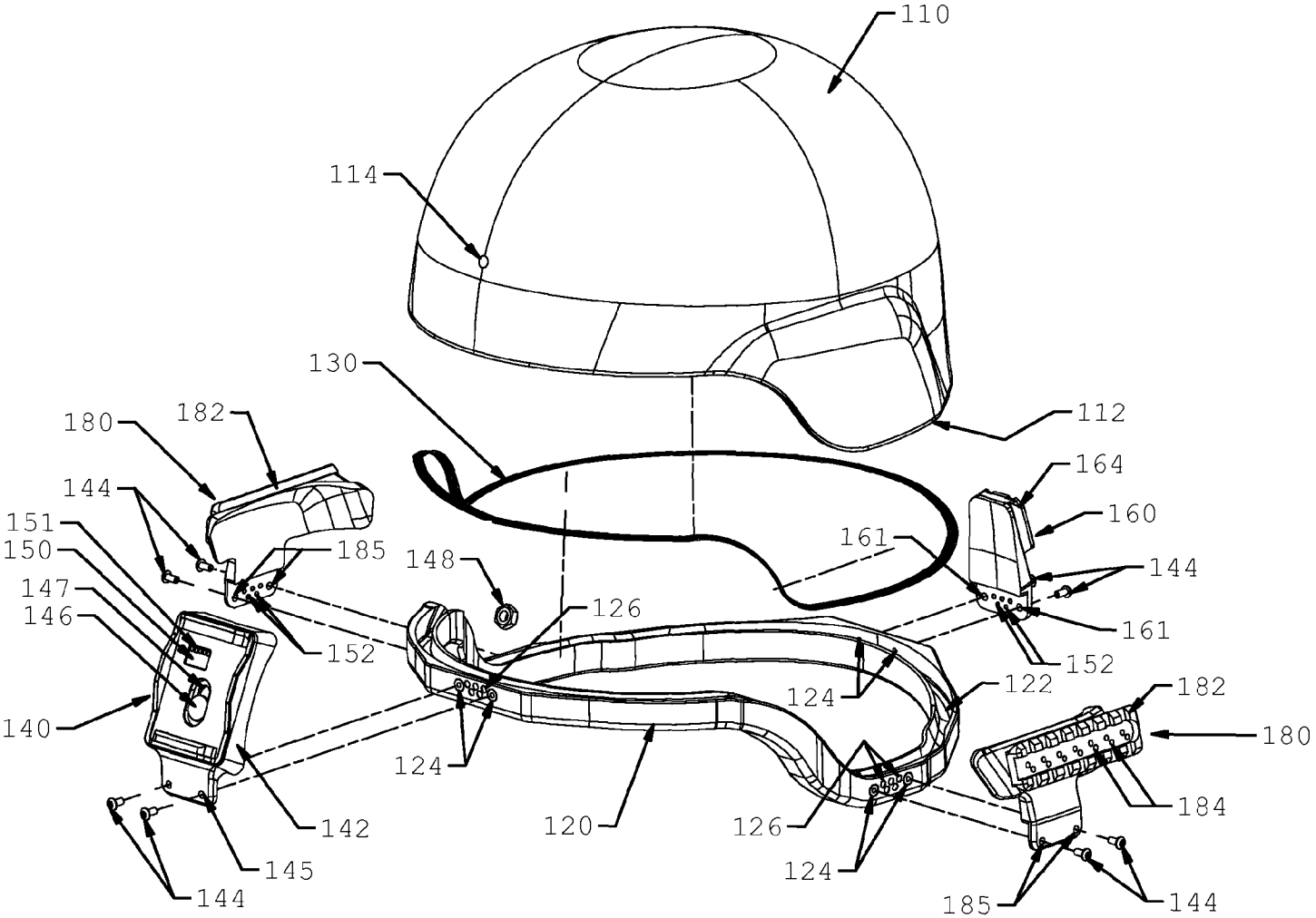
FIG. 3 is an exploded, isometric view of the embodiment appearing in FIG. 1.
Figure 4:
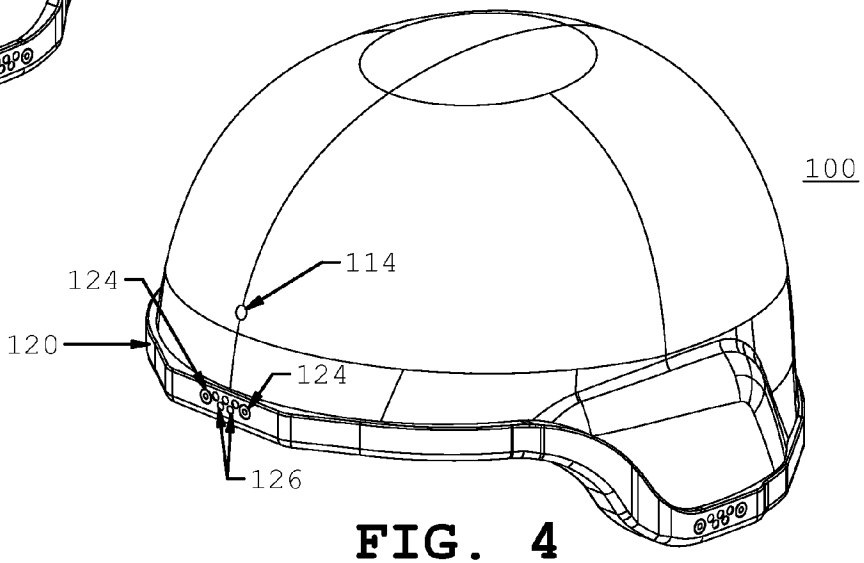
FIGS. 4 and 5 are generally front and rear isometric views of the helmet embodiment appearing in FIG. 3, with the electrical connectors removed.
Figure 5:
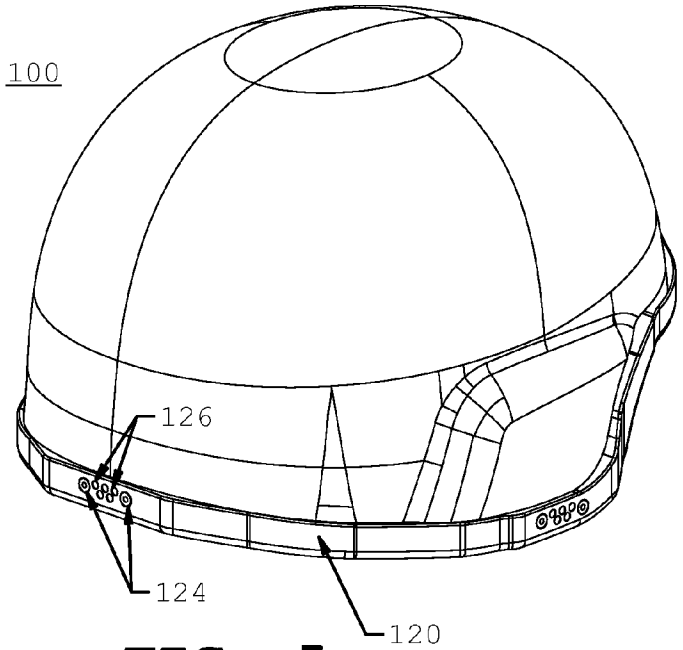
Figure 7:
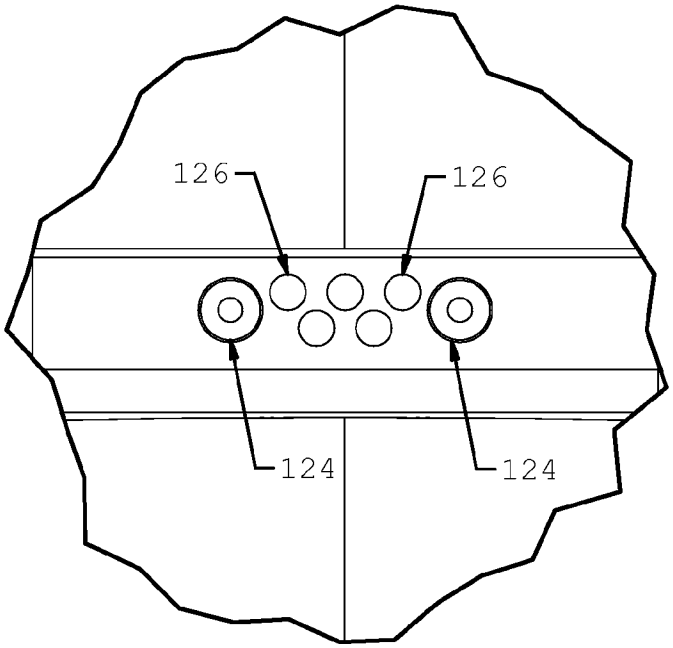
FIG. 7 is an enlarged view of the region A appearing in FIG. 6.
Figure 6:
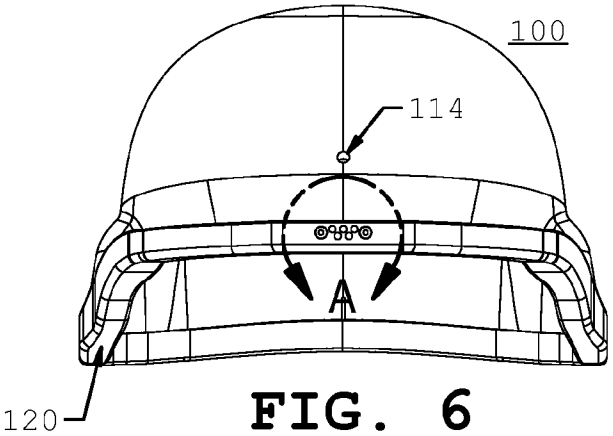
FIG. 6 is front elevational view of the embodiment appearing in FIGS. 4 and 5.
Figure 8:
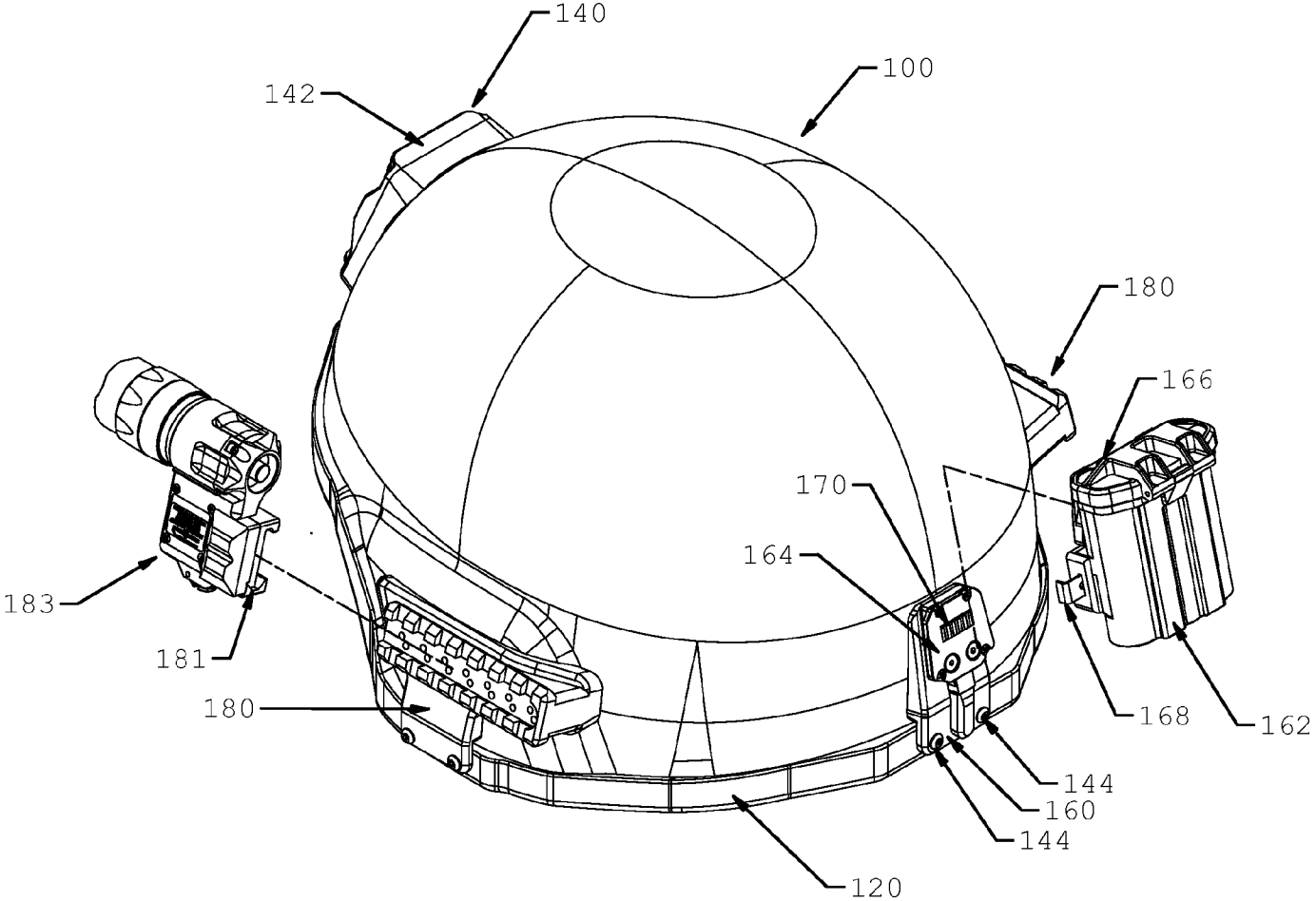
FIG. 8 is an isometric view taken generally from the rear and side, illustrating the manner of attachment of accessories and a power supply.
Figure 9:
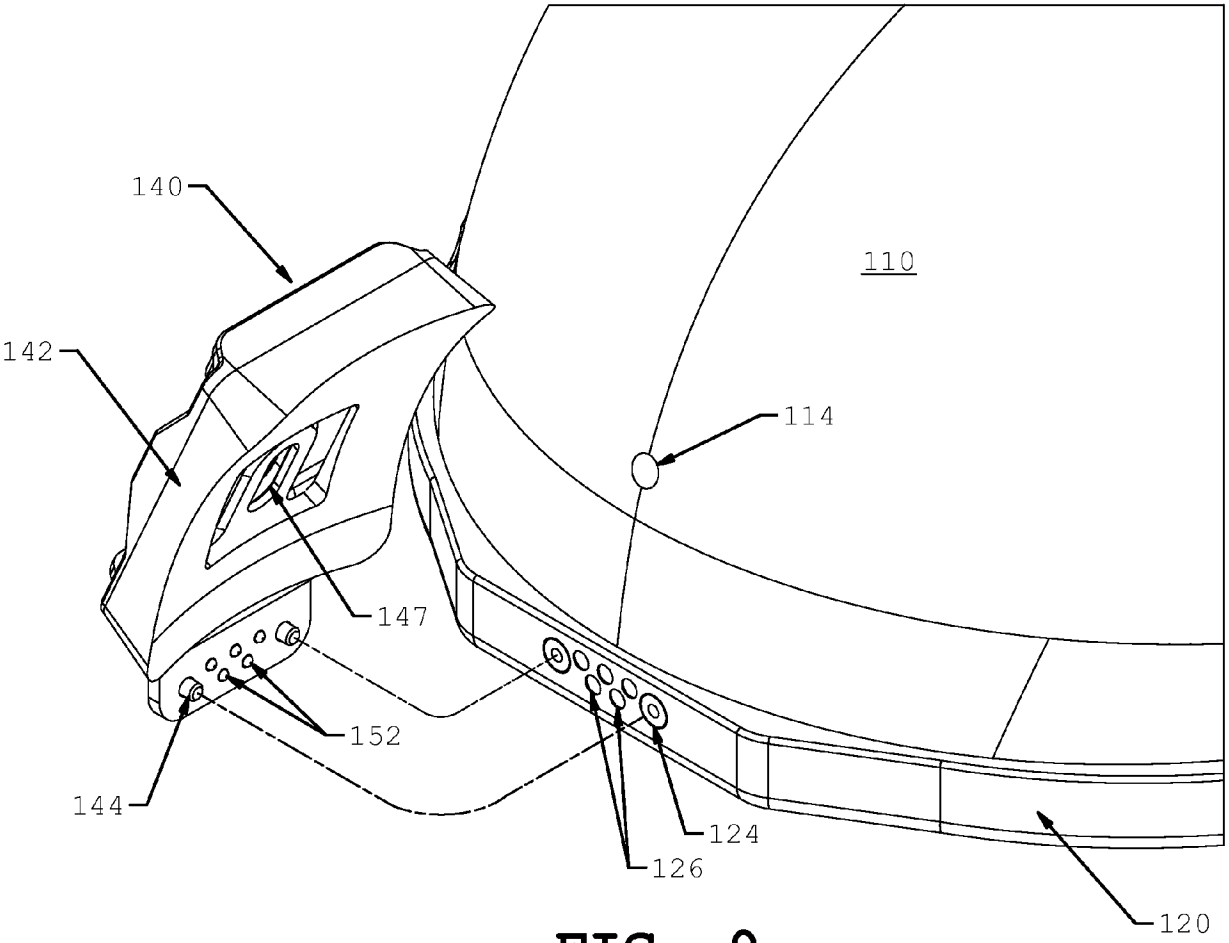
FIG. 9 is an enlarged view of the front of the helmet, illustrating the manner of attachment of a bracket or shroud for attaching a night vision device, such as an NVG or eNVG, or other optical or viewing device.
Figure 10:
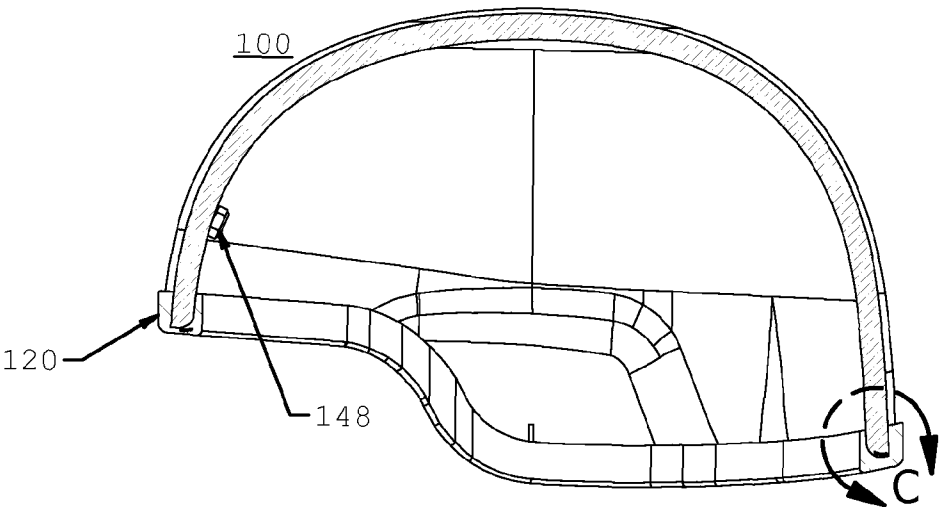
FIG. 10 is a side cross-sectional view of the helmet embodiment appearing in FIGS. 4 and 5.

Referring now to the drawings wherein like reference numerals designate like parts throughout the several views, FIGS. 1-12 illustrate a helmet 100, which may advantageously be a ballistic helmet although other helmet types are contemplated as well. The helmet 100 includes a shell 110, which may be formed, e.g., by laying up multiple plies of a fiber reinforced composite material on a generally helmet-shaped pre-form. Such composite material may include fibers, e.g., polymer fibers such as aramid fibers (e.g., KEVLAR®) or other ballistic fiber impregnated with a polymer resin. Other ballistic and non-ballistic helmet types, including metal helmets, molded plastic helmets, etc., are also contemplated.

An edge trim member 120 is shaped to correspond to the peripheral edge 112 of the shell 110 and defines a groove or channel 122 sized to receive the unfinished edge 112 of the shell 110. The edge trim member may be a molded construction or, alternatively, may be formed as an elongate strip by extrusion and cut to the appropriate length.

A wiring harness or circuit member 130 is received within the groove 122. The circuit 130 may comprise a ribbon cable comprising a plurality of conductors 132 (5 conductors in the exemplary embodiment illustrated although other numbers of conductors are contemplated). Alternatively, the circuit member may comprise a flexible circuit substrate such as a flexible polymer film having conductive tracings formed thereon. In still further embodiments, the conductive elements may be formed directly in the edge trim member 120, e.g., by molding the circuit elements within the edge trim or printing circuit elements directly on the edge trim member.

Figure 11:
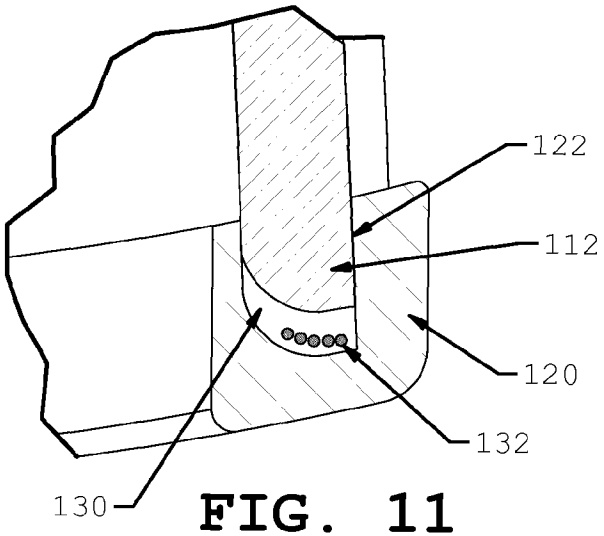
FIG. 11 is an enlarged view of the region C appearing in FIG. 10.

As best seen in FIG. 11, the circuit member 130 is seated between the unfinished helmet brim 112 and the base of the groove 122. The edge trim member 122 is secured to helmet shell 110 via an adhesive, e.g., an epoxy adhesive or the like, although other fasteners such as mechanical fasteners are also contemplated.

In the depicted embodiment, there appear four device connectors coupled to the edge trim member, including a front connector 140, a rear connector 160, and left and right side connectors 180. It will be recognized, however, that other numbers of connectors, spacings, and electrical connector configurations are also contemplated.

The front mounting member 140 includes a bracket or shroud 142 adapted to attach a night vision goggle, enhanced night vision goggle, or other optical device (not shown) to be positioned in in front of one or both eyes of a user. In preferred embodiments, the bracket 142 is adapted to attach a pivoting mount which allows the user to selectively move the optical or viewing device between a lowered, operable position in front of the user's eyes and to a raised, stowed position on the helmet out of the line of sight of the viewer.

In the illustrated embodiment, the front connector 140 is secured to the edge trim member via threaded fasteners 144 which engage aligned openings 145 in the bracket 142 and openings 124 in the edge trim member. The openings 124 may be reinforced, e.g., via tapped metal inserts. In the illustrated embodiment, a bolt 146 passes through an opening 147 on the bracket 142 and an opening 114 in the shell 110 and receives a complimentary nut 148 to further secure the front connector 140 to the helmet 110.

An electrical connector 150 is provided on the exterior surface of the front connector 140. The electrical connector is positioned to align with a mating connector on a helmet mount (not shown) for attaching an optical/viewing device. The electrical connector 150 is adapted to connect to an electrical connector on a helmet mount, which in turn is electrically coupled to electrical contacts on a mounting shoe for the optical/viewing device. It will be recognized, however, that other arrangements are possible.

The electrical connector 150 includes contacts 151, which are electrically coupled to protruding contacts 152 (see FIG. 9) on the inward facing surface of the front connector 140.

Each of the contacts 152 makes contact with a corresponding aligned contact 126, e.g., flush or recessed contact pads, on the edge trim member 120. The contacts 152 are preferably spring contacts, i.e., resiliently biased toward the contacts 126 to ensure a sold electrical connection therebetween.

The electrical connector 160 is adapted to receive a power supply, e.g., a battery or battery pack, 162. The connector 160 is secured to the edge trim 120 via threaded fasteners 144, which pass through openings 161 in the connector 160 and engage complimentary openings 124 in the edge trim 120. The rear connector 160 includes a mounting shoe 164, e.g., a dovetail type mounting shoe for receiving a complimentary female dovetail connector 166 on the power supply 162. The power supply may also include a latch 168 to release the power supply 162 and replacing the power supply 162 with a new of newly charged power supply. It will be recognized that other connectors, such as a bayonet or other quick connect/disconnect type connectors on the battery pack and the rear connector are also contemplated. Electrical contacts 170 on the mounting shoe 164 align with corresponding contacts (not shown) on the power supply connector 166.

Figure 12:
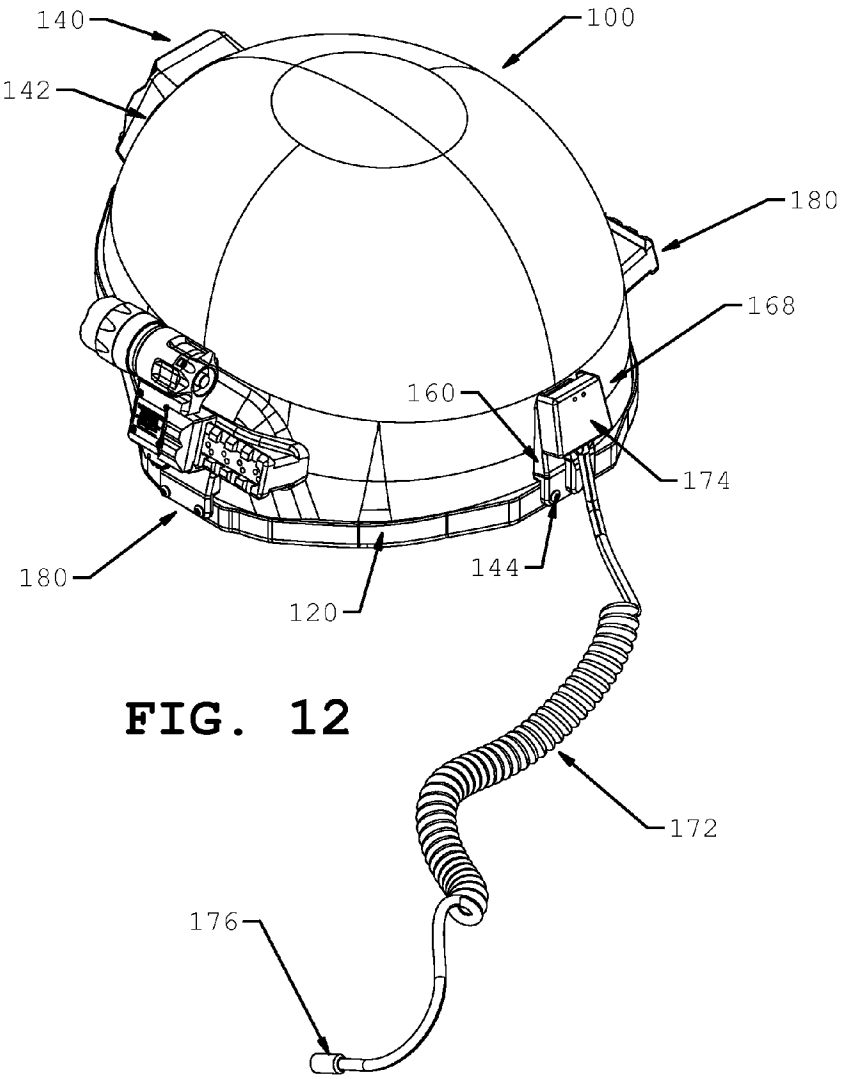
FIG. 12 is a generally rear isometric view illustrating an exemplary electrical connector for electrically coupling the edge trim circuit to a power supply remotely located from the helmet.

The contacts 170, in turn, are electrically coupled to corresponding spring contacts 152. The spring contacts 152, in turn, are coupled to aligned contacts 126 on the edge trim 120 (see FIG. 5). In alternative embodiments, as shown in FIG. 12, the power supply 162 may be replaced with a connector 172 having a first end 174 mating with the connector 160 and a second end 176 mating with an electrical connector of a power supply, such as a power supply adapted to be worn by the user or incorporated into a garment worn by the user.

Left side and right side connectors 180 are secured to the edge trim member at the respective left and right sides of the helmet 110 via threaded fasteners 144 which pass through aligned openings 185 in the connectors and engage openings 124 in the edge trim member. The side connectors 180 as illustrated include a rail section 182 configured to allow clamping via a rail grabber 181 of an accessory device 183 to be attached.

In the illustrated embodiment, the side mounted accessory 183 is a flashlight, however, it will be recognized that all manner of accessories may be provided, including without limitation, friend/foe (IFF) transponders, cameras including video recording (e.g., DVR) devices, communication devices, and so forth. In the illustrated embodiment, the rail section conforms to the so-called Picatinny interface standard (e.g., MIL-STD-1938) although other mounting rails, brackets, etc., are contemplated as well.

The rail interface 182 includes contacts 184 which are electrically coupled to protruding contacts 152 (see FIG. 3) on the inward facing surface of the side connectors 180. Each of the contacts 152 makes contact with a corresponding aligned contact 126, e.g., flush or recessed contacts, on the edge trim member 120. Again, the contacts 152 are preferably spring or otherwise resiliently biased contacts. The contacts 184 are adapted to provide an electrical coupling through the rail interface 182 and to the connectors 152.

In addition to powering externally mounted devices, the edge trim circuit herein may also optionally be adapted to power in-helmet devices, such as devices embedded within the helmet or devices mounted within the interior of the helmet, i.e., between the used head and the interior surface of the shell. For example, the power supply attached via the connector 160 may supply power to a helmet recording system such as a monitor for recording and/or transmitting the shock profile or forces experienced by the helmet.

In the illustrated embodiment, the circuit is shown with five conductors, which may be used to provide power from the power supply to the attached devices, as well as data or control signals to record data or to allow one attached accessory device to operate or control another without the need for an external wired connection between the multiple devices.

The invention has been described with reference to the preferred embodiments. Modifications and alterations will occur to others upon a reading and understanding of the preceding detailed description. It is intended that the invention be construed as including all such modifications and alterations.

What is claimed is:

1. A protective helmet, comprising:

an outer shell bounded by a peripheral edge;

an edge trim attached to and extending around the peripheral edge;

a wiring harness disposed within the edge trim;

one or more power connectors on the outer shell configured to attach to an electrical power source;

one or more device connectors on the outer shell configured to connect to an electrically powered device; and the wiring harness electrically coupled to the one or more power connectors and the one or more device connectors;

wherein each of the one or more the device connectors includes a mechanical fastener for removably attaching a powered device and further including a first set of electrical contacts which is aligned with a second set of electrical contacts on the powered device when the powered device is attached.

2. The protective helmet of claim 1, wherein the wiring harness is integral with the edge trim.

3. The protective helmet of claim 1, wherein the wiring harness comprises a plurality of conductive elements.

4. The protective helmet of claim 1, wherein the wiring harness is received between the peripheral edge and the edge trim.

5. The protective helmet of claim 1, wherein the wiring harness is selected from a ribbon cable and a flexible circuit substrate carrying one or more printed circuit elements.

6. The protective helmet of claim 1, wherein the wiring harness comprises a flexible circuit substrate formed of a flexible polymer film having one or more conductive elements printed thereon.

7. The protective helmet of claim 1, wherein the edge trim defines a channel receiving the peripheral edge.

8. The protective helmet of claim 1, wherein each of the one or more the power connectors includes a mechanical fastener for removably attaching a power source and further including a first set of electrical contacts which is aligned with a second set of electrical contacts on the power source when the power source is attached.

9. The protective helmet of claim 1, further comprising one or more powered devices selected from the group consisting of flashlights, illumination devices, passive night vision devices, enhanced night vision devices, thermal imaging devices, cameras, video recorders, and friend or foe identification (IFF) devices.

10. The protective helmet of claim 1, further comprising a mount attached to a front portion of the outer shell for positioning a viewing device in front of an eye of a user wearing the helmet.

11. The protective helmet of claim 1, wherein the helmet is a ballistic helmet.

12. The protective helmet of claim 1, wherein the outer shell comprises a ballistic shell formed of multiple plies of reinforcing fibers within a polymer matrix material.

13. The protective helmet of claim 1, wherein the edge trim is formed of a material selected from a molded polymer material and an extruded polymer material.

14. The protective helmet of claim 1, wherein the wiring harness includes a plurality of conductors for transmitting one or more of power, data signals, sensor signals, and communication signals.

15. The protective helmet of claim 1, wherein the peripheral edge is unfinished.

16. The protective helmet of claim 1, wherein the edge trim is secured to the peripheral edge with a mechanical fastener.

17. The protective helmet of claim 1, wherein the edge trim is permanently secured to the peripheral edge with an adhesive.

18. The protective helmet of claim 17, wherein the adhesive is an epoxy adhesive.

19. A protective helmet, comprising:

an outer shell bounded by a peripheral edge;

an edge trim attached to and extending around the peripheral edge; and a wiring harness disposed within the edge trim;

one or more power connectors on the outer shell configured to attach to an electrical power source;

one or more device connectors on the outer shell configured to connect to an electrically powered device; and the wiring harness electrically coupled to the one or more power connectors and the one or more device connectors;

wherein each of the one or more the power connectors includes a mechanical fastener for removably attaching a power source and further including a first set of electrical contacts which is aligned with a second set of electrical contacts on the power source when the power source is attached.

* * * * *